US005655233A

United States Patent [19]

Lackey, Jr.

[11] Patent Number: 5,655,233

[45] Date of Patent: Aug. 12, 1997

[54] TOILET DOME

[76] Inventor: Gary R. Lackey, Jr., 725 Spruce, Kansas City, Mo. 64124

[21] Appl. No.: 590,272

[22] Filed: Nov. 21, 1995

[51] Int. Cl.[6] ..... A47K 13/14

[52] U.S. Cl. ..... 4/661; 4/234; 4/243.1; 4/253

[58] Field of Search ..... 4/661, 300.3, 234, 4/243.1, 253, 901, 902, DIG. 5, DIG. 18

[56] References Cited

U.S. PATENT DOCUMENTS

| | | | |
|---|---|---|---|
| 3,193,845 | 7/1965 | Funk | 4/300.3 |
| 4,348,776 | 9/1982 | Sarjeant | 4/300.3 |
| 5,276,925 | 1/1994 | Blaha | 4/DIG. 5 |
| 5,373,589 | 12/1994 | Rego et al. | 4/DIG. 5 |
| 5,564,135 | 10/1996 | Jones, et al. | 4/300.3 |

*Primary Examiner*—Henry J. Recla
*Assistant Examiner*—Charles R. Eloshway
*Attorney, Agent, or Firm*—Chase & Yakimo

[57] ABSTRACT

A decorative cover for a toilet comprises a fabric shaped by a plurality of ribs, the ribs pivotally mounted to the rear of the toilet seat. The ribs are of sequentially reduced configurations allowing for a fully nested relationship therebetween. The ribs are movable to a first nested relationship adjacent the water reservoir which collapses the cover and allows access to the toilet bowl. Upon movement of the nested ribs away from their nested relationship, the cover is extended between the water reservoir and towards the toilet rim. A fixed spacer cover encloses the space between the water reservoir and one end of the collapsible cover.

20 Claims, 5 Drawing Sheets

TOILET DOME

BACKGROUND OF THE INVENTION

This invention relates to a toilet seat and, more particularly, to an improved toilet seat assembly including a dome-like cover having collapsible or extensible positions.

The use of the conventional toilet seat/lid assembly atop the conventional toilet bowl is known. Various approaches have been undertaken to improve the aesthetic appearance of this toilet seat, including the use of decorative materials, padding, graphics and the like. However, no matter what aesthetic approach has been taken the basic appearance of the toilet has remained the same. Accordingly, it is desirable to present an improved toilet seat assembly which enhances the appearance of the toilet seat particularly when the toilet seat assembly is in a closed position.

In response thereto I have invented a toilet dome which is selectably positioned between collapsed and extended positions. At the extended position a fabric dome extends between the water reservoir of the toilet and the horizontal seat. Upon raising the seat to an upright position the dome collapses so as to allow for functional use of the underlying toilet bowl. The dome may also be collapsed by the user while the seat remains in a horizontal position. The toilet dome may be made of various decorative fabrics which will enhance the aesthetic appearance of the bathroom.

It is therefore a general object of this invention to provide a decorative cover for a toilet bowl.

Another object of this invention is to provide a cover, as aforesaid, in the form of a collapsible dome extending between the toilet tank and a closed lid of the toilet seat.

A further object of this invention is to provide a cover, as aforesaid, wherein the dome collapses when the toilet seat is moved from a horizontal to an upright position.

Still a further object of this invention is to provide a cover, as aforesaid, presenting a plurality of ribs for supporting the decorative cover.

Another particular object of this invention is to provide a cover, as aforesaid, wherein the aforesaid ribs nest one within another upon the seat being swung between a horizontal position and an upright position.

Still another particular object of this invention is to provide a cover, as aforesaid, including a lid for overlying the horizontally positioned seat.

A further particular object of this invention is to provide a cover, as aforesaid, which will not interfere with the function of the underlying toilet bowl.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
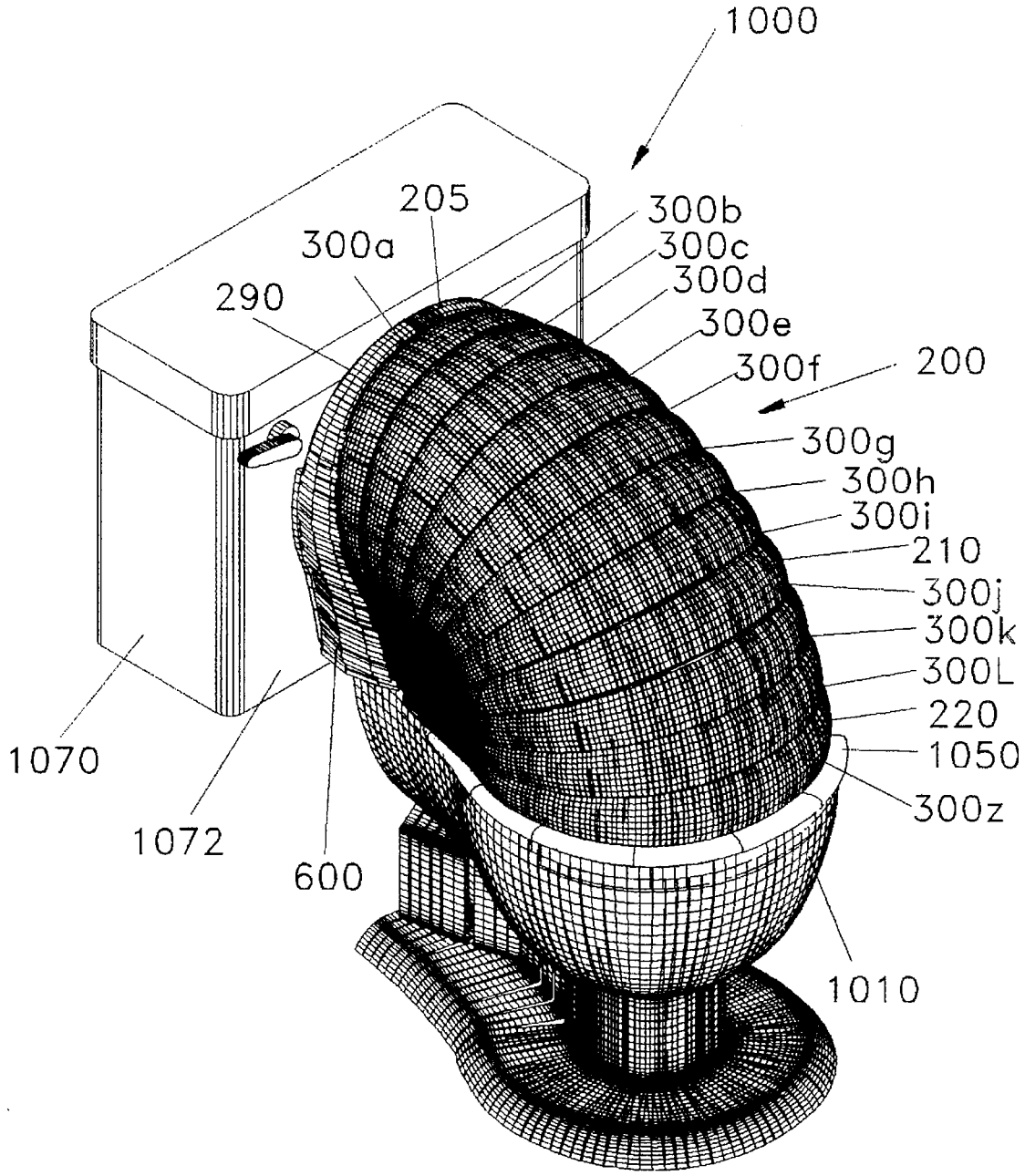
FIG. 1 is a perspective view illustrating the dome in an extended position, the seat being in a down, horizontal position.

Turning more particularly to the drawings, FIG. 1 illustrates the dome assembly 200 in position above a conventional toilet 1000, the latter comprising a toilet bowl 1010 with seat 1050 thereon. A water reservoir 1070 communicates with bowl 1010.

Figure 5:
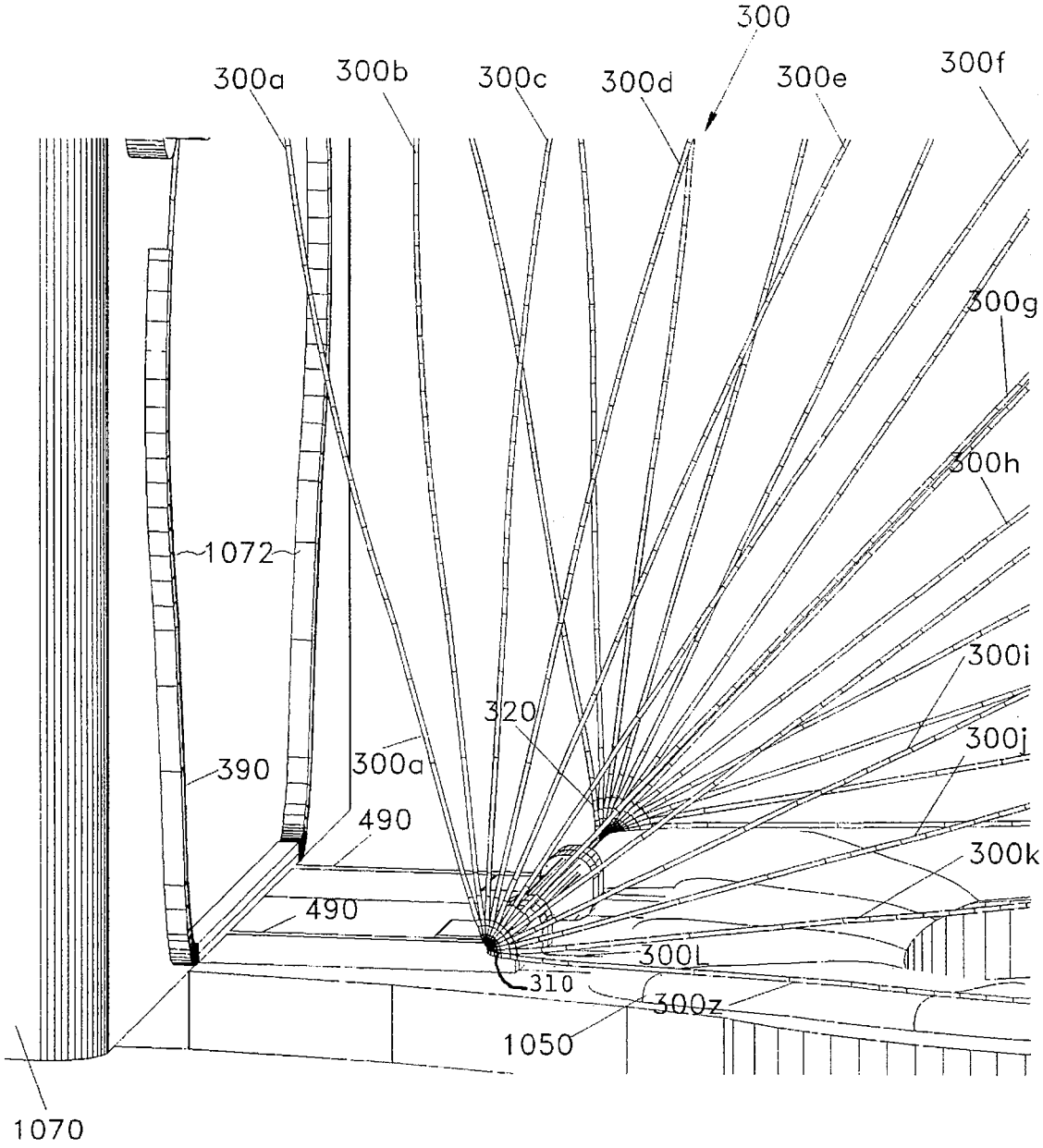
FIG. 5 illustrates a portion of the plurality of reinforcing ribs for affixing the toilet dome to the toilet bowl.

The dome assembly 200 comprises a flexible, decorative cover 210 mounted about a rib array 300 which includes a plurality of reinforcing ribs 300*a*–3001, 300*z*. Each rib has first 310 and second 320 ends which are swingably mounted in a spoke-like fashion about horizontal rib portions 312, 322, these portions being attached to lobes 412, 422 of the arms 402, 404 of hinge assembly 400. The hinge assembly 400 includes brackets 414, 424 which are attached to the horizontal portion 1080 of the toilet located between the rim 1090 and reservoir 1070 in lieu of the conventional hinge assembly. The ribs of array 300 are generally U-shaped in configuration, as fragmentarily shown in FIG. 5, and are relatively reduced in their overall configuration between the largest rib 300*z* closest to the seat 1050 and the smallest rib 300*a* closest to the water reservoir 1070 to allow a nesting relationship therebetween.

Figure 2:
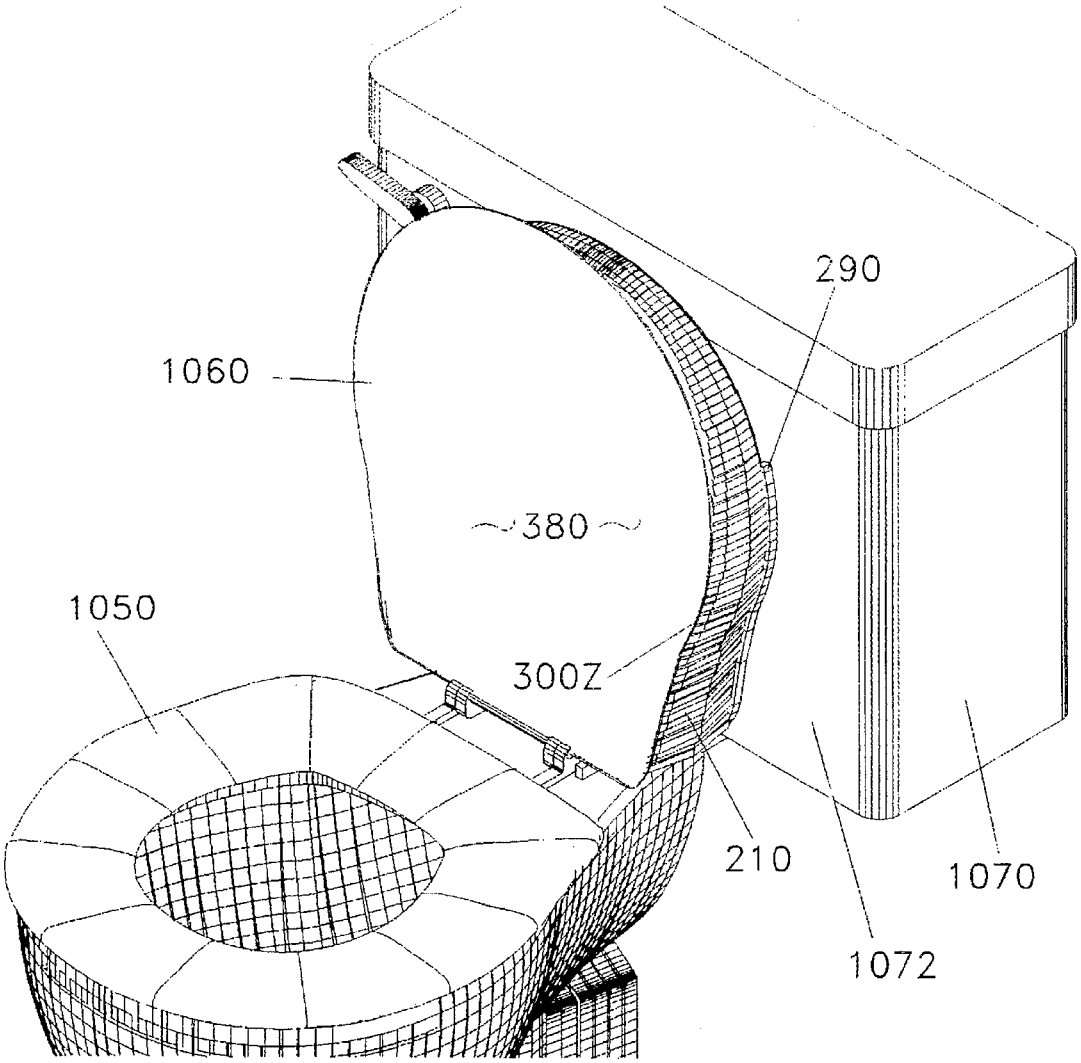
FIG. 2 is a perspective view from the opposed side of the toilet bowl with the dome in its collapsed position, the toilet seat being in a horizontal position.

One end 220 of the flexible cover 210 is attached about the perimeter of the largest rib 300*z*. A solid surface 380 may be positioned within the confines of the rib 300*z* as shown in FIG. 2, so as to present a lid. The other end 205 of cover 210 is attached to rib 300*a*. A stationary rib 390 is attached to the front surface 1072 of the water reservoir 1070 so that one end of a preformed spacer cover 290 may be attached thereto. This spacer cover 290 extends (at 600) along flanges 490 rearwardly extending from the hinge assembly 400. The other end of spacer cover 290 may be free or attached to rib 300*a*. Thus, this fixed spacer cover 290 will extend between the water reservoir 1070 and rib 300*a* of the plurality of ribs 300.

The hinge assembly 400 is attached to the rim portion 1080 in lieu of the conventional hinge. The hinge assembly 400 includes arms 402, 404 with lobes 412, 422 rotatable about shaft 406. The free end of arms 402, 404 is attached to seat 1050. Thus, the hinge assembly 400 allows the seat 1050 to be swung between its horizontal (FIG. 2) and vertical (FIG. 3) positions. As such the ribs are nestable one within the other so that rib 300*z* may contain the remaining plurality ribs within its confines.

The movement of the seat 1050 between the down (FIG. 2) and up (FIG. 3) positions urges a swingable movement of the adjacent rib 300*z* and sequentially adjacent ribs 3001–300*a*. As such, the nested relationship of the configurations of these ribs 300 allows each rib to sequentially nest within an adjacent rib while the seat 1050 swings to its FIG. 3 position. Alternatively, the seat 1050 may remain in its FIG. 2 horizontal position while the largest rib 300*z* is rearwardly swung towards the rib 300*a* and water reservoir 1070, the relative rib configurations allowing the ribs 300 to nest therebetween.

Figure 3:
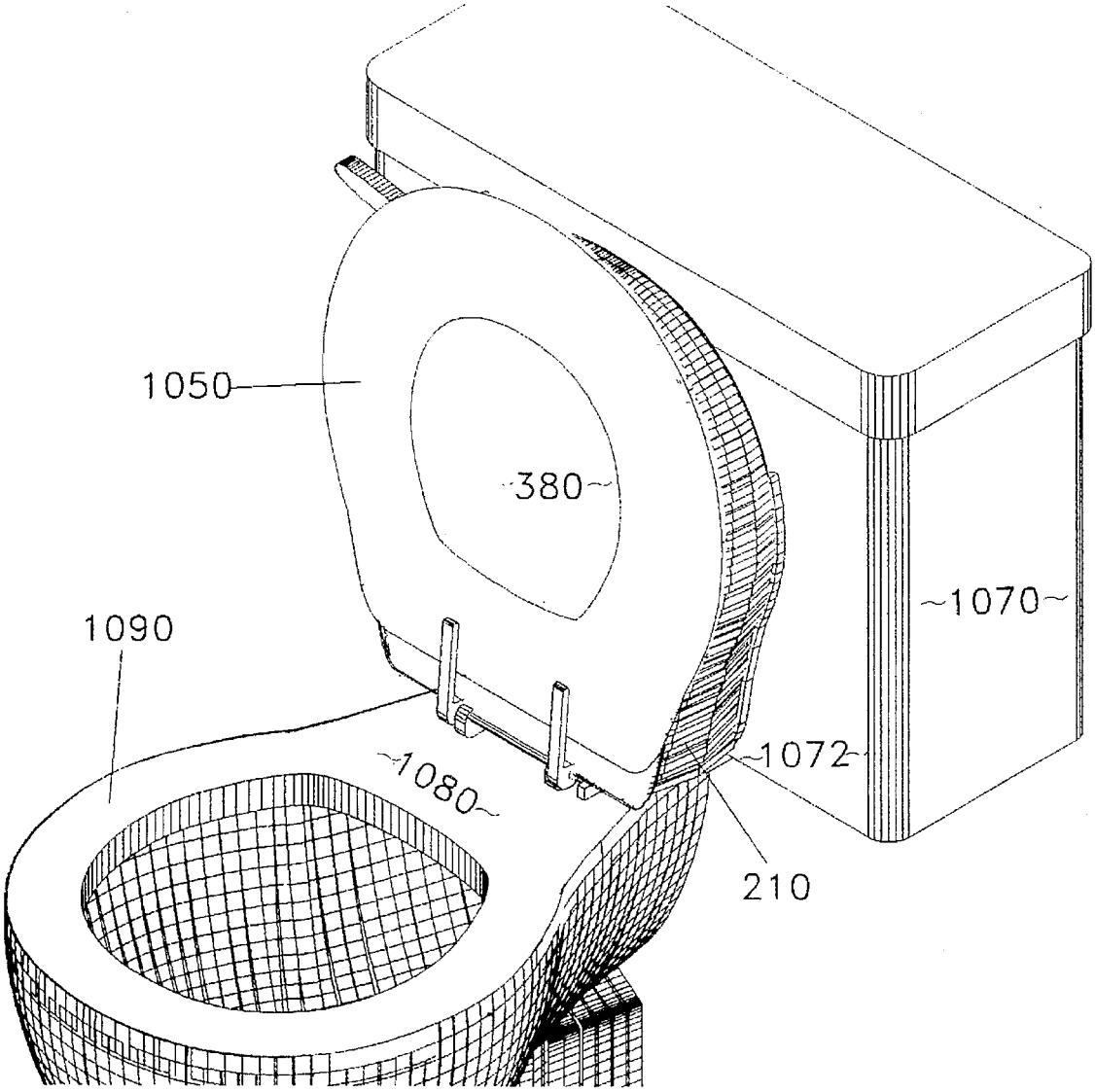
FIG. 3 is a perspective view similar to FIG. 1 showing the collapsed dome with the toilet seat in an upright position.
Figure 4:
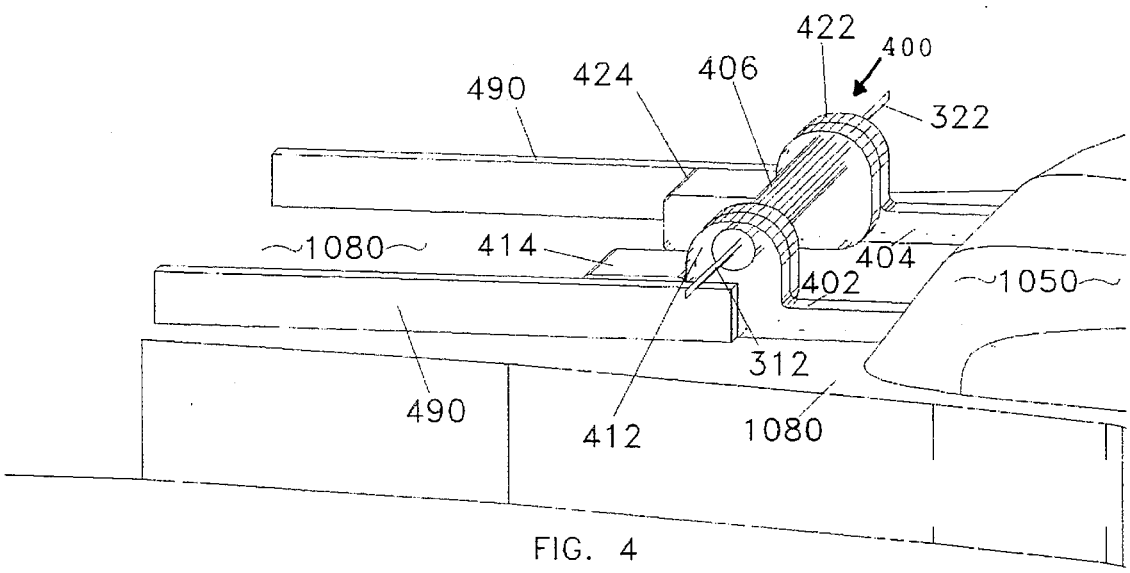
FIG. 4 is a fragmentary view of the hinge assembly, on an enlarged scale, for affixing the toilet seat to the conventional toilet bowl.

During movement of the ribs 300 towards reservoir 1070 the cover 210 will collapse to its FIG. 2 or 3 positions allowing access to the toilet 1000. Upon swingable movement of the ribs 300 in an opposed direction, the ribs 300 are in a radially spaced-apart relationship (FIG. 4). Accordingly, the cover is concurrently extended from a collapsed position to the FIG. 1 position. As such, the toilet dome 210 is movable between a first, collapsed toilet accessible position (FIGS. 2, 3) and a second, extended cover position (FIG. 1). The fixed spacer cover 290 fills the space between the rib 300*a* and water reservoir 1070, it being understood that the spacer cover 290 may not always be needed or desired.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A cover assembly for placement atop a rim of a conventional toilet bowl having a water reservoir and seat swingable between horizontal and vertical positions, said assembly comprising:

a flexible cover;

a plurality of ribs attached to said cover, each of said ribs having a relative configuration for providing a nested relationship therebetween;

means for swingably mounting said ribs to a portion of the toilet rim, said ribs swingable between a first nested position for collapsing said attached cover and allowing a user access to the bowl and a second position for extending said attached cover atop the seat.

2. The cover as claimed in claim 1 wherein said mounting means comprises:

first and second brackets mounted atop said rim portion;

means for swingably mounting first and second ends of each of said ribs respectively to said first and second brackets.

3. The cover as claimed in claim 1 wherein said plurality of ribs comprises:

a first rib adjacent the water reservoir of the toilet;

a second rib movable between horizontal and vertical positions;

at least one rib intermediate said first and second ribs, said plurality of ribs having relative configurations therebetween to present said nested relationship.

4. The cover as claimed in claim 3 further comprising:

a second cover having a configuration corresponding to said first rib;

means for mounting said second cover to extend between the water reservoir and said first rib.

5. The cover as claimed in claim 4 wherein said second cover mounting means comprises a fixed rib adapted to be connected to a front surface of the water reservoir, said second cover having an end mounted to said fixed rib.

6. The cover as claimed in claim 5 wherein said second cover further comprises an opposed end adjacent said first rib whereby the second cover extends between the water reservoir and said first rib.

7. The cover as claimed in claim 6 wherein said opposed end of said second cover is attached to said first rib.

8. The cover as claimed in claim 3 wherein movement of the seat between the horizontal and vertical positions urges said seat against said second rib, said seat movement urging said second rib towards said first rib and said at least one intermediate rib into said nested rib relationship.

9. The cover as claimed in claim 3 further comprising a solid surface within said second rib, said surface presenting a lid for the seat at said second position.

10. A cover assembly for placement atop a rim of a conventional toilet bowl having a water reservoir and seat swingable between horizontal and vertical positions, said assembly comprising:

a flexible cover;

a plurality of ribs for shaping said cover, each of said ribs having a relative configuration for providing a nested relationship therebetween;

means for swingably mounting first and second spaced-apart ends of each of said ribs to a portion of the toilet rim, said ribs swingable between a first position away from the seat for collapsing said cover and allowing a user access to the bowl and a second position towards the seat for extending the attached cover between the water reservoir and toilet seat.

11. The cover as claimed in claim 10 wherein said plurality of ribs comprises:

a first rib adjacent the water reservoir of the toilet;

a second rib movable between horizontal and vertical positions;

at least one rib intermediate said first and second ribs, said plurality of ribs having relative configurations whereby to present the nested relationship among said ribs.

12. The cover as claimed in claim 11 further comprising:

a second cover having a configuration corresponding to said first rib;

means for mounting said second cover to extend between the water reservoir and said first rib.

13. The cover as claimed in claim 12 wherein said second cover mounting means comprises a fixed rib adapted to be connected to a front surface of the water reservoir, said second cover having an end mounted to said fixed rib.

14. The cover as claimed in claim 13 wherein said second cover further comprises an opposed end adjacent said first rib whereby the second cover extends between the water reservoir and said first rib.

15. A cover assembly for placement atop a rim of a conventional toilet bowl having a water reservoir and a seat swingable between horizontal and vertical positions, said assembly comprising:

a flexible cover;

a plurality of ribs attached to said cover;

means for mounting said ribs to a portion of the toilet rim in swingable movement between a first position adjacent the reservoir for collapsing the cover and a second position for extending the cover between the water reservoir and toilet rim.

16. The cover as claimed in claim 15 wherein said plurality of ribs comprises:

a first rib adjacent the water reservoir of the toilet;

a second rib movable between horizontal and vertical positions;

a plurality of ribs intermediate said first and second ribs, said plurality of ribs having relative configurations whereby to nest said ribs therebetween upon movement of said ribs to said first position.

17. The cover as claimed in claim 16 wherein said ribs are in a radially spaced-apart relationship in said second position of said ribs corresponding to said extension of said cover.

18. The cover as claimed in claim 16 wherein an end of said cover is attached to said first rib.

19. The cover as claimed in claim 16 wherein an end of said cover is attached to said second rib.

20. The cover as claimed in claim 15 wherein said ribs are generally U-shaped in configuration.

* * * * *